US010024141B2

(12) United States Patent
Swinford

(10) Patent No.: US 10,024,141 B2
(45) Date of Patent: Jul. 17, 2018

(54) APPARATUS AND METHOD OF CLEANING AN OIL WELL-BORE

(71) Applicant: Jason Swinford, Spring, TX (US)

(72) Inventor: Jason Swinford, Spring, TX (US)

( * ) Notice: Subject to any disclaimer, the term of this patent is extended or adjusted under 35 U.S.C. 154(b) by 137 days.

(21) Appl. No.: 15/256,647

(22) Filed: Sep. 5, 2016

(65) Prior Publication Data

US 2018/0066499 A1 Mar. 8, 2018

(51) Int. Cl.
*E21B 37/00* (2006.01)
*E21B 41/00* (2006.01)

(52) U.S. Cl.
CPC ..... *E21B 37/00* (2013.01); *E21B 41/0078* (2013.01)

(58) Field of Classification Search
CPC ..... E21B 37/00; E21B 37/04; E21B 21/00; E21B 12/00; E21B 7/00
See application file for complete search history.

(56) References Cited

U.S. PATENT DOCUMENTS 2,735,794 A * 2/1956 Pletcher ..... A23G 9/30 134/102.1
5,195,585 A * 3/1993 Clemens ..... E21B 37/00 166/222
5,564,500 A * 10/1996 Rogers ..... E21B 21/103 166/222
6,059,202 A * 5/2000 Zink ..... B05B 3/026 239/259
6,840,315 B2 * 1/2005 Jarchau ..... E21B 41/0078 166/169
7,686,102 B2 * 3/2010 Swinford ..... E21B 4/02 175/107
8,298,349 B2 * 10/2012 Wojciechowski, III .. B05B 3/06 134/166 R
8,312,930 B1 * 11/2012 Glass ..... E03B 3/15 166/223
2006/0086507 A1 * 4/2006 Surjaatmadja ..... E21B 37/00 166/312
2014/0116782 A1 * 5/2014 Bonett Ordaz ..... E21B 10/60 175/57
2014/0231546 A1 * 8/2014 Etschel ..... E21B 37/08 239/245
2016/0251940 A1 * 9/2016 De Witt ..... E21B 37/00 166/304

* cited by examiner

*Primary Examiner* — Michael R Wills, III
(74) *Attorney, Agent, or Firm* — Eric P. Mirabel

(57) ABSTRACT

The invention is a cleaning device and method for cleaning an oil well-bore. The device includes a longitudinal passage and plurality of distribution passages extending from it and terminating near the exterior of the cleaning device in fluid ejection ports which have a progressively widening diameter towards their outermost end. The distribution passages and ports are oriented around a longitudinal axis of the device such that on injection of pressurized cleaning fluid into the longitudinal passage, jets of cleaning fluid are ejected from the ports. The ejected jets being substantially tangential to the outer surface of the device, generate rotational torque on one or more components of the device and cause them to spin. The device may further include a supplementary attachment such as a dual-purpose drilling bit. To perform cleaning, the device is connected to one end of a coiled tubing and is inserted in the well-bore.

19 Claims, 9 Drawing Sheets

APPARATUS AND METHOD OF CLEANING AN OIL WELL-BORE

FIELD OF INVENTION

This invention relates to apparatus and method for cleaning an oil well-bore.

BACKGROUND

Oil wells and natural gas are generally drilled into the earth and the underground oil or gas deposits are forced to the surface along the well bore by the underground pressure, or, pumped up using one or more pumps (often in a series). The well-bore is drilled from an oil-rig on the surface of earth using a rotating drilling bit. When the rotating drilling bit is driven into the earth, it cuts through layers of soil and rocks using a continuous flow of compressed drilling fluid (also known as "drilling mud") supplied through a conduit, which can be coiled tubing or a drill string (composed of a contiguous series of pipes).

During drilling, hollow metallic tubes (also known as "casings") are inserted within the drilled bore to prevent the walls of bore from collapsing. In a deep enough bore, multiple hollow casings are installed vertically one above the other by screwing ends of adjacent sections with each other, thus forming a "bore casing." For reliable installation of bore casings (and for proper functioning of equipment set-up within it), the well-bore should be kept clean by efficiently removing mud, rock debris and dirt generated during drilling, and it should also be periodically cleaned to maintain reliable functioning of the in-well equipment.

Various tools and methods have been proposed for cleaning of an oil well-bore. For example, U.S. Pat. Nos. 7,686,102 and 8,151,908 (both incorporated by reference) disclose well-bore cleaning devices which use jets of pressurized fluid ejecting from one end of a tool to dislodge mud, dirt or rock debris in an oil well-bore. While drilling the oil well-bore, these tools are not very efficient in removing mud/dirt stuck on inner walls of the bore casing at positions already passed by the end of the tool from which jets of pressurized fluid are ejected. So in order to clean such portions, the tools may be required to pass multiple times up and down the oil well-bore. Hence, there's need for an improved cleaning device which more efficiently and effectively cleans the base and internal walls of a well-bore without multiple passes up and down being required.

SUMMARY

The invention is a cleaning device and a method for cleaning an oil well-bore, for use with coiled tubing. The cleaning device is connected to one end of a coiled tubing and is inserted in the bore casing of the well-bore, either before the tubing is inserted in the well-bore, or, following reeling up of the coiled tubing from the well-bore. The upper end of the cleaning device is attached to the coiled tubing, and it hangs from the tubing into the well-bore. Once the cleaning device is placed in proximity of a target portion of the well-bore to be cleaned, pressurized cleaning fluid (such as drilling fluid or mud) is injected into the cleaning device from the coiled tubing, and jets of injected fluid are shot from one or more fluid ejection ports of the cleaning device against the inner surface of the well-bore or the casing. The fluid ejection ports have a progressively widening inner diameter from their innermost to their outermost end, and these ports are oriented to eject the fluid substantially tangentially to the outer surface of the cleaning device. The jets of fluid are preferably substantially horizontal (which is transverse to the well-bore axis, in vertical drilling), but may also be angled off the horizontal/transverse direction, as desired, including to virtually any orientation away from the cleaning device and non-parallel to longitudinal axis of it. Further, the jets are preferably substantially tangential to the outer surface of the substantially cylindrical cleaning device as to generate rotational torque and cause the device, or at least the device components where the fluid is ejected, to spin with respect to the longitudinal axis of the cleaning device. Again, other angles off tangential are within the scope of the invention.

The cleaning device may be equipped with a supplementary attachment having one or more additional fluid ejection ports (which may be similar to the fluid ejection ports of the cleaning device). Further, the jets of fluid shot from the fluid ejection ports of supplementary attachment are preferably substantially horizontal (or transverse to the well-bore axis), but may also be angled off the horizontal/transverse direction, as desired, including to virtually any orientation away from the cleaning device, and may also be parallel to the longitudinal axis of it.

Still further, in some embodiments, the supplementary attachment could be a dual-purpose drilling bit. Such a dual-purpose drilling bit facilitates additional jets to further enhance cleansing and drilling action by generation of added rotational torque.

In one embodiment, the cleaning device includes an upper-sub which connects to one end of the coiled tubing, an injection tube, an upper-bushing, a holding cylinder, a tubular barrel, a lower-sub and a supplementary attachment. Both the lower-sub and the supplementary attachment include one or more fluid ejection ports. The upper sub, the injection tube, the upper-bushing, the holding cylinder, the tubular barrel, the lower-sub and the supplementary attachment are aligned along their respective longitudinal axes. The cleaning device includes a continuous longitudinal bore extending from the upper sub and through the injection tube, the upper-bushing, the holding cylinder, and the lower-sub, thus providing a longitudinal passage for the cleaning fluid to enter through the upper-sub and get delivered into the lower-sub.

Some portion of the injected fluid also flows into the supplementary attachment (if present) through branched passages accessing the longitudinal passage of the cleaning device through the lower-sub. In operation, pressurized fluid supplied from the coiled tubing travels through the longitudinal passage, and gets ejected through the fluid ejection ports of the lower-sub and/or the supplementary attachment.

The spinning of the lower sub and portions of the cleaning device attached to it, caused by ejection of fluid from the ejection ports in the lower sub and in the attachment, provides enhanced cleansing of the inner surface of the well-bore, the casing or of equipment in the well bore.

Embodiments of the cleaning device are discussed in greater detail with reference to the accompanying figures in the detailed description which follows.

Figure 1A:
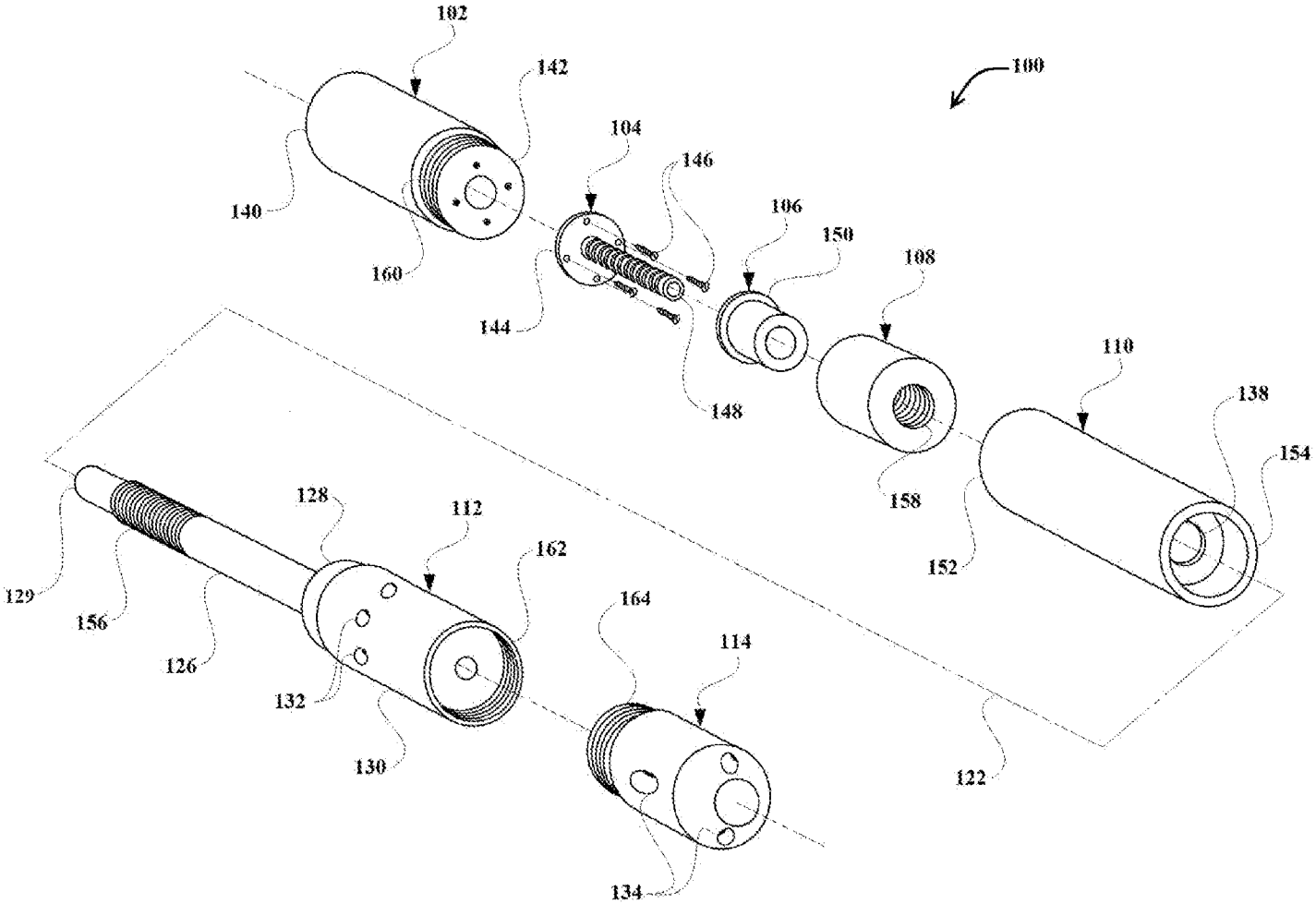
FIG. 1A is an exploded view of a first embodiment of cleaning device of the invention.
Figure 1B:
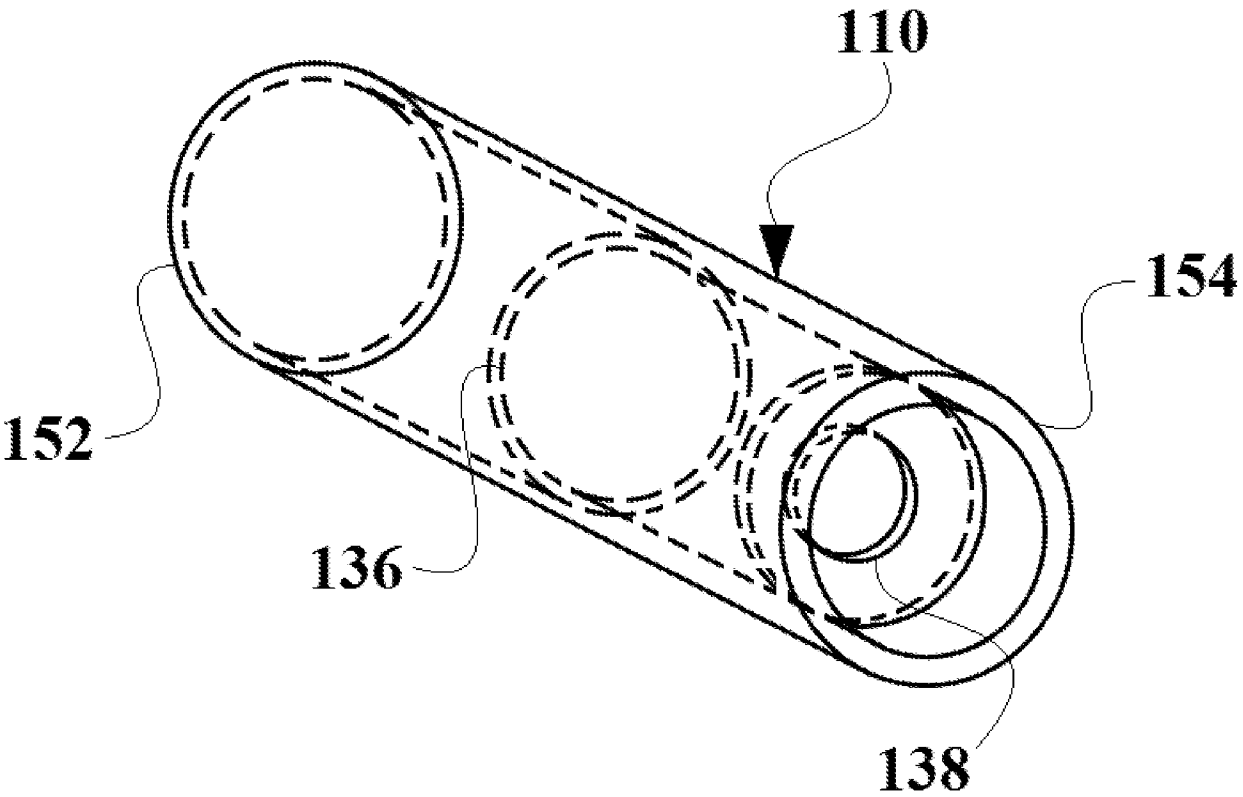
FIG. 1B is perspective view of the tubular barrel.

It should be understood that the drawings and the associated descriptions below are intended only to illustrate one or more embodiments of the present invention, and not to limit the scope of the invention. The drawings are not necessarily to scale.

DETAILED DESCRIPTION

Reference will now be made in detail to a first embodiment of a cleaning device of the invention with reference to the accompanying FIGS. 1A-4. As illustrated in these figures, cleaning device 100 comprises an upper-sub 102, an injection tube 104, an upper-bushing 106, a holding cylinder 108, a tubular barrel 110, a lower-sub 112 and a supplementary attachment 114. The upper-sub 102 connects to coiled tubing 116 (illustrated in FIG. 4), which extends into bore casing 118 of an oil well-bore 120. The supplementary attachment 114 faces the base of the well-bore 120 and serves as an additional component for further enhancing cleaning action of cleaning device 100. In an operational cleaning device 100, pressurized cleaning or drilling fluid/mud is injected into the cleaning device 100 through the coiled tubing 116 via the upper-sub 102. Thereafter, jets of pressurized cleaning or drilling fluid/mud are ejected from the cleaning device 100 onto the inner side of the casing section to be cleaned. Ejecting jets of fluid generates rotational torque on the lower-sub 112 and the supplementary attachment 114, and causes them to spin about a longitudinal axis 122 of cleaning device 100.

The upper-sub 102, the injection tube 104, the upper-bushing 106, the holding cylinder 108, the tubular barrel 110, the lower-sub 112 and the supplementary attachment 114, are substantially symmetrical about their respective longitudinal axes. Once assembled to form the cleaning device 100, they all lie essentially symmetrically about the common longitudinal axis 122 of the cleaning device 100. Further, upper-sub 102, injection tube 104, upper-bushing 106, holding cylinder 108, tubular barrel 110, lower-sub 112, and a portion of supplementary attachment 114 each include a longitudinal bore, whereby assembled cleaning device 100 has a longitudinal passage 124 (illustrated in FIGS. 2A and 2B) for fluid (such as drilling or cleaning fluid) to enter through upper-sub 102 and get delivered into lower-sub 112, with some of it also passing into supplementary attachment 114.

Lower-sub 112 further includes a covering tube 126, a tubular section 128, a fluid jet ejection section 130, and six fluid ejection ports 132. Supplementary attachment 114 further includes four fluid ejection ports 134. Longitudinal passage 124 of the assembled cleaning device is substantially symmetrical around longitudinal axis 122.

The internal portion of tubular barrel 110 further includes two annular ridges (illustrated as 136 and 138). In the assembled cleaning device, while the second annular ridge 138 (illustrated in FIGS. 1A, 1B and 2A) assists in prevention of displacement of lower-sub 112 towards a first end 152 of tubular barrel 110, the first annular ridge 136 (illustrated in FIGS. 1B and 2A) assists in prevention of displacement of holding cylinder 108 towards a second end 154 of tubular barrel 110.

In the assembled cleaning device 100, while one end of upper-sub 102 (illustrated as end 140) connects to coiled tubing 116, its other end (illustrated as end 142) is screwed to one end of tubular barrel 110. The other end of tubular barrel 110 surrounds the tubular section 128 of lower-sub 112.

To assemble the cleaning device 100, on the surface of the end 142, a circular flange 144 of injection tube 104 is attached through four connecting bolts 146. Attachment of the circular flange 144 provides a passage for pressurized fluid from upper-sub 102 to enter longitudinal passage 124 of injection tube 104. If needed, one or more of appropriate sealant/s such as sealing chemicals or sealing washers may be used for leak-proofing of the interface of the upper-sub 102 and circular flange 144. The outer diameter of tubular extension 148 of injection tube 104 matches with inner diameter of covering tube 126.

In the next step, from the first end 152 of tubular barrel 110, holding cylinder 108 is inserted longitudinally into tubular barrel 110 and placed adjacent first annular ridge 136. The second end 154 of tubular barrel 110 is then placed over tubular section 128 of lower-sub 112 in a manner such that covering tube 126 lies within the cavity of tubular barrel 110. An outer threaded portion 156 of covering tube 126 gets screwed with an internally threaded portion 158 of the holding cylinder 108.

Once lower-sub 112 and covering tube 126 get screwed to tubular barrel 110 and holding cylinder 108 respectively, tubular section 128 lies adjacent to the second annular ridge 138. Upper-bushing 106 is placed against the free tip 129 of covering tube 126, and the first end 152 of tubular barrel 110 is connected to upper-sub 102, by screwing the first end 152 to an externally threaded portion 160 lying proximal to end 142 of upper-sub 102. Since the inner diameter of covering tube 126 matches the outer diameter of the tubular extension 148, once assembled, injection tube 104 is inserted into the covering tube 126. Once screwing of assembly of tubular barrel 110 and upper-sub 112 is completed, almost the entire length of tubular extension 148 is covered by covering tube 126, and the upper-bushing 106 (having tubular extension 148 passing through it) gets locked between circular flange 144 and holding cylinder 108. Further, while the axial movement of holding cylinder 108 is prevented by first annular ridge 136 and upper-bushing 106, it still remains free to rotate about the longitudinal axis 122. Upper-bushing 106 can either be a high elasticity material, or a material with suitable flexibility, so as to ensure that holding cylinder 108 remains longitudinally stationary during rotation. Upper bushing 106 may also seal one end of the interface of tubular extension 148 and covering tube 126. Similarly, while the longitudinal movement of lower-sub 112 towards upper-sub 102 (i.e. towards first end 152) is prevented by second annular ridge 138, its longitudinal movement away from upper-sub 102 is prevented by holding cylinder 108 which is screwed to it. Further, since the outer surface of tubular extension 148 and the inner surface of covering tube 126 are grooved, the interface of these surfaces are essentially leak-proof and prevent escape of pressurized fluid flowing from upper-sub 102 to lower-sub 112 during operation.

To complete assembly of cleaning device 100, internally threaded end 162 of lower-sub 112 is connected with an externally threaded end 164 of supplementary attachment 114. During operation of cleaning device 100, fluid from upper-sub 102 travels through the injection tube 104 and gets delivered to lower-sub 112 and supplementary attachment 114 through longitudinal passage 124.

The fluid jet ejection section 130 of lower-sub 112 includes fluid ejection ports 132, which are not surrounded by tubular barrel 110. Each fluid ejection port 132 has a progressively widening inner diameter from their innermost to their outermost end, and each fluid ejection ports 132 is connected to longitudinal passage 124 through a corresponding distribution passage 166. Distribution passage 166 extend perpendicularly from a portion of longitudinal passage 124 lying within lower-sub 112, and permit ejection of fluid flowing through longitudinal passage 124 through fluid ejection ports 132. The longitudinal axis of each distribution passage 166 and its corresponding fluid ejection port 132 is preferably substantially transverse to axis 122 and each fluid ejection port 132 is oriented to eject fluid in the same direction, which is substantially tangential to the outer surface of fluid jet ejection section 130 of the lower-sub 112. Ejection of fluid through ports 132 generates a rotational torque on the lower-sub 112 (and components screwed to it) and causes the lower-sub 112 (and components screwed to it) to spin on axis 122. The jets of ejected fluid hit the target portions/equipment in the well-bore casing 118 and dislodge mud/dirt or debris thereon.

Figure 2A:
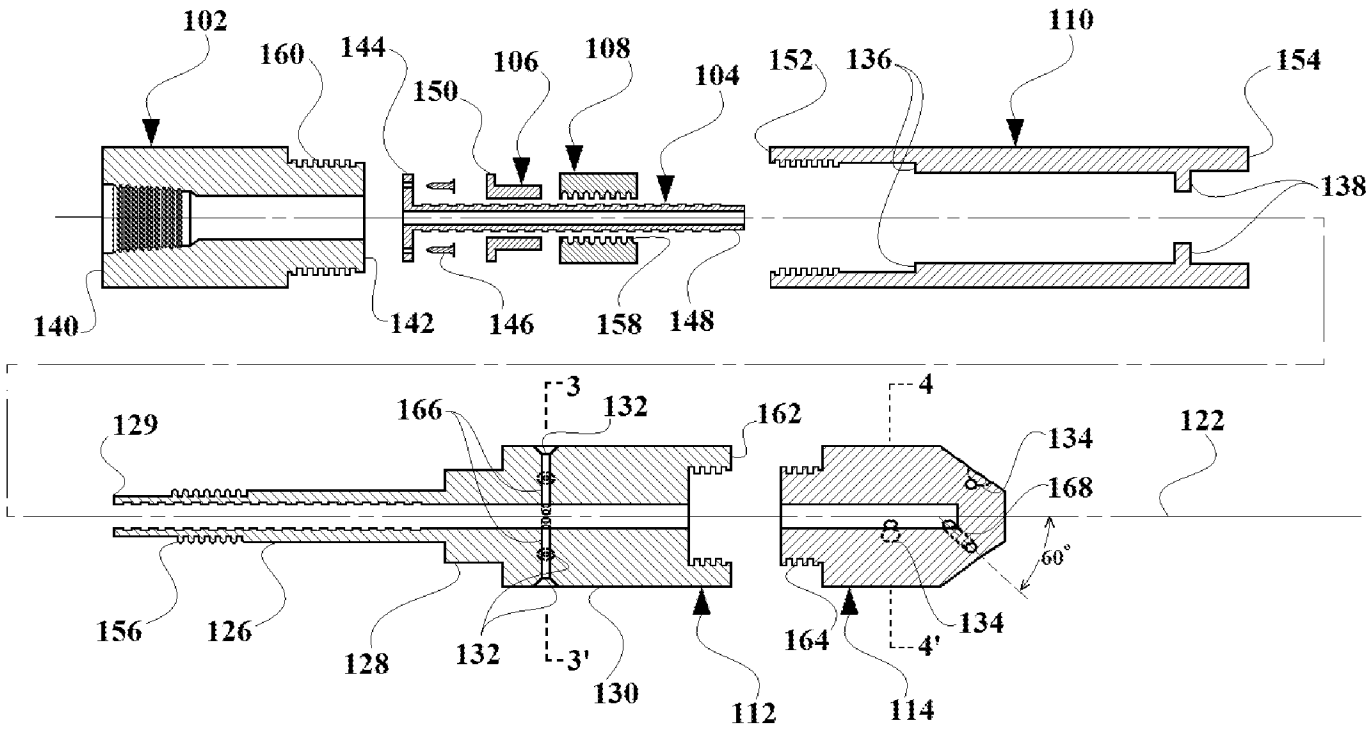
FIG. 2A is an exploded cross-sectional view of the first embodiment of the cleaning device of the invention.
Figure 2B:
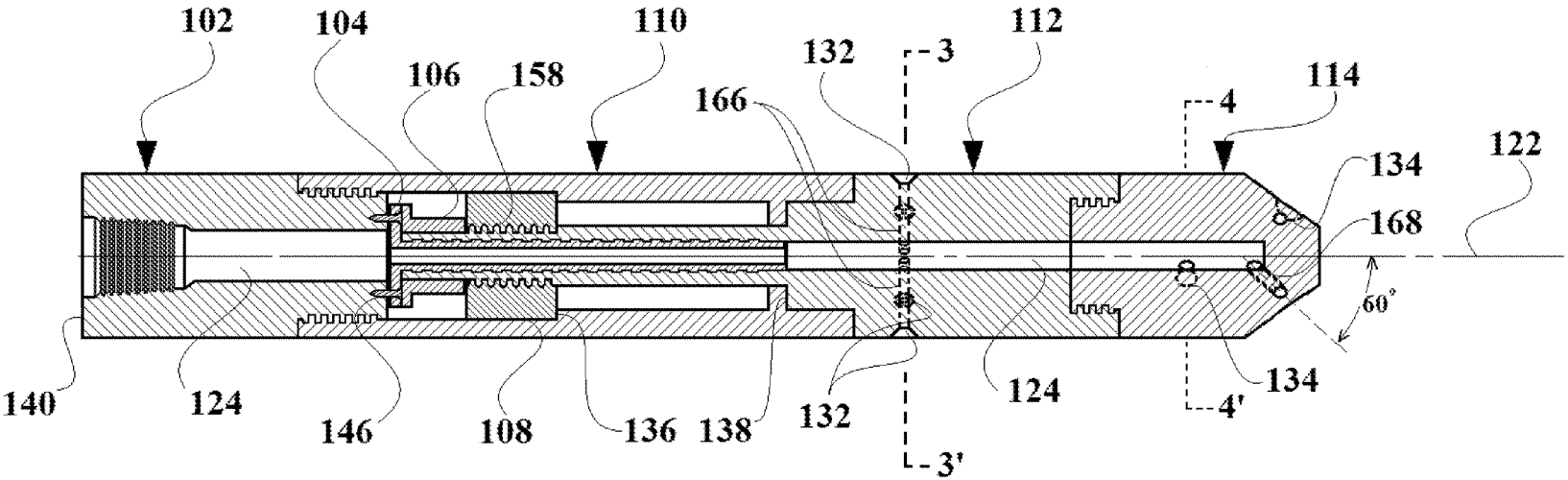
FIG. 2B is a cross-sectional view of the first embodiment of the cleaning device of the invention.
Figure 3A:
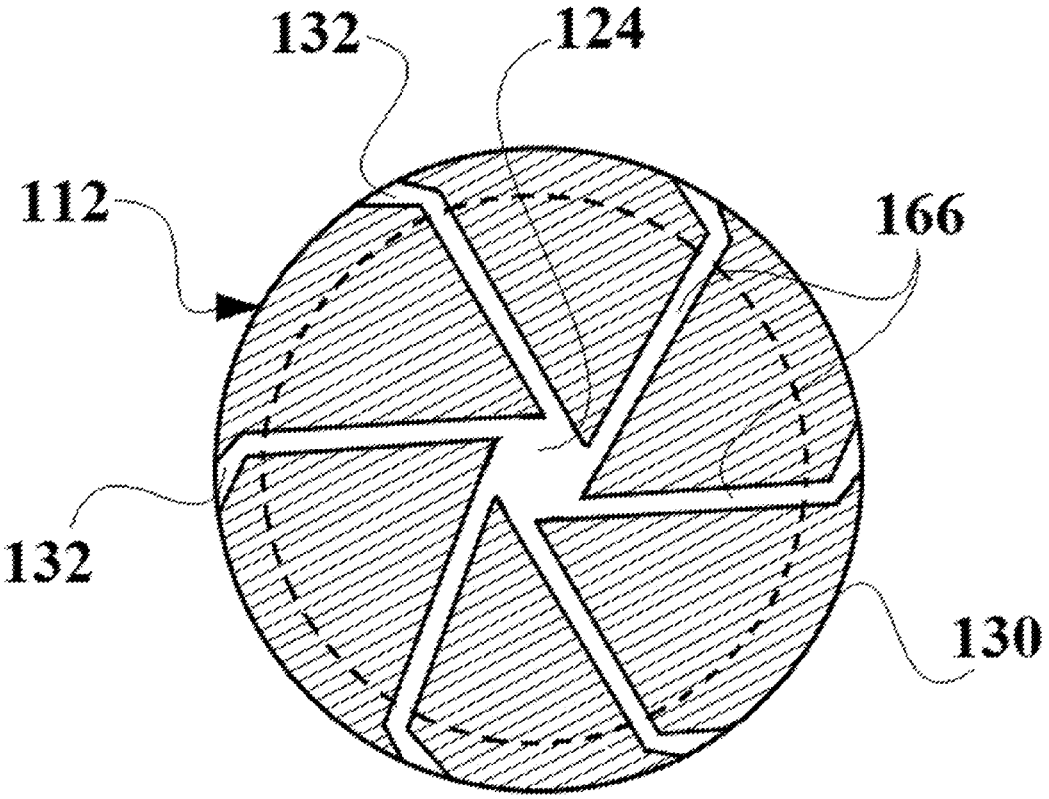
FIG. 3A illustrates a cross-section of a fluid jet ejection section of a lower-sub of the first embodiment of the invention taken along the lines 3-3' of FIGS. 2A and 2B.
Figure 3B:
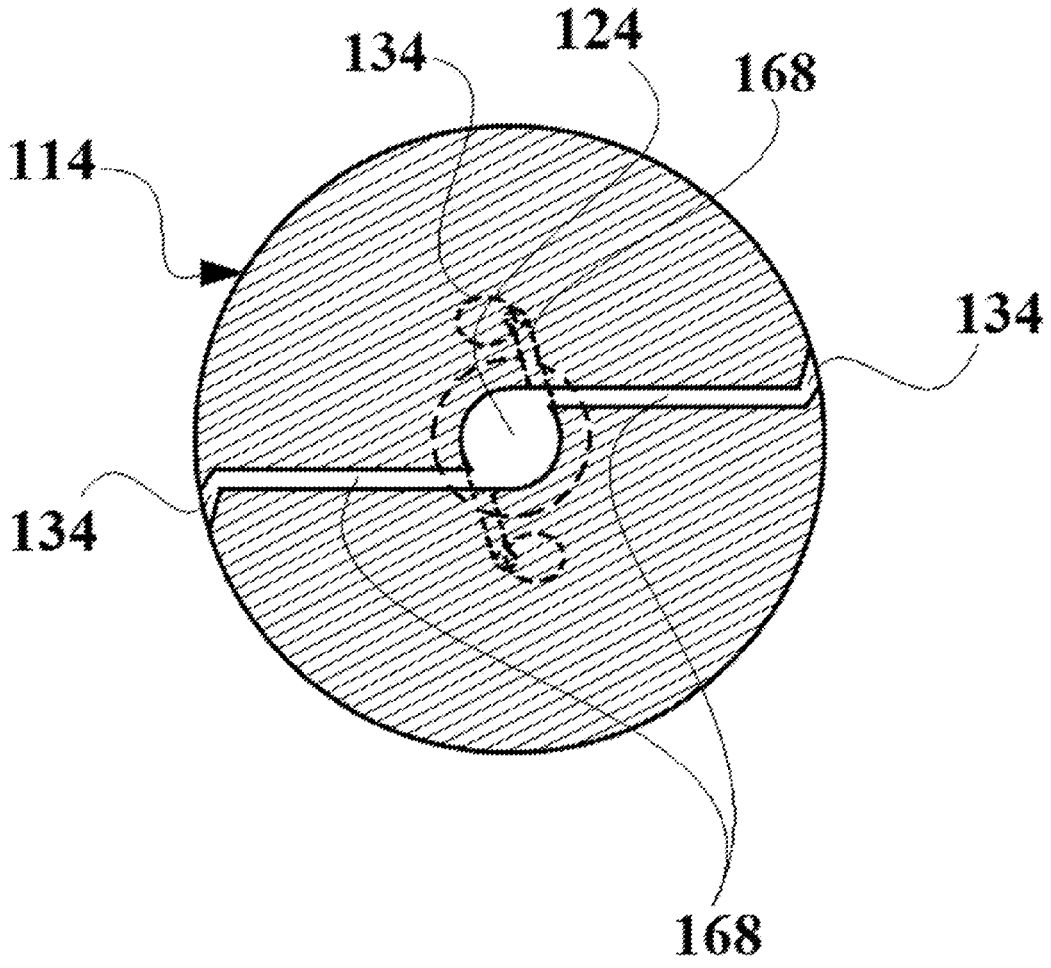
FIG. 3B illustrates a cross-section of a supplementary attachment of the first embodiment of the invention taken along the lines 4-4' of FIG. 2A (or 2B) and being perpendicular to its longitudinal axis.

Not all the pressurized fluid entering lower-sub 112 gets ejected through fluid ejection ports 132. Some of it is passed to supplementary attachment 114 through longitudinal passage 124. In supplementary attachment 114, longitudinal passage 124 furcates into four branched passages 168. Each branched passage 168 terminates into one of four fluid ejection ports 134, such that pressurized fluid entering supplementary attachment 114 passage 124 is ejected out through ejection ports 134. Similar to fluid ejection ports 132, each fluid ejection port 134 has a progressively widening inner diameter from their innermost to their outermost end. Branched passages 168 and their corresponding fluid ejection ports 134 are oriented such that the jets of ejected fluid are either substantially transverse to longitudinal axis 122, or at an angle between transverse and parallel (as shown in FIGS. 2A and 2B) or may also be parallel to longitudinal axis 122. In the embodiment shown, two of the branched passages 168 are substantially transverse to longitudinal axis 122, the other two branched passages 168 lie tilted away from the end 164 (or from the lower-sub 112) at an angle of about 60 degrees with respect to longitudinal axis 122. In an operational cleaning device, the two branched passages 168 lie tilted towards the bottom of the well-bore 120. These additional jets of ejected fluid aid in dislodging target substances (such as stuck mud/dirt or debris) from the well-bore or casing. Branched passages 168 and their corresponding fluid ejection ports 134 are oriented to eject fluid in the same direction as the jets ejected by ports 132, which is substantially tangential to the outer surface of supplementary attachment 114, so that the ejected fluid jets generate rotational torque on supplementary attachment 114 (and components screwed to it, i.e. lower-sub 112). Generated rotational torque aids in rotation of supplementary attachment 114 and lower-sub 112. Fluid jets ejecting from ports 132 and 134 while device 100 is rotating means that a larger inner surface area of the well-bore or casing is thoroughly washed, than is the case with only one set of ejection ports. Further, jets of fluid ejected by ports 132 and 134 are directed such that the torque generated by each jet contributes to strengthening the overall spinning or rotating force or cumulative torque acting on the assembly of lower-sub 112 and supplementary attachment 114.

Lower-sub 112 and supplementary attachment 114 are held in place by holding cylinder 108, whose movement in the longitudinal direction is prevented. However, the since holding cylinder 108 is attached to the assembly of lower-sub 112 and the supplementary attachment 114, it rotates about the longitudinal axis 122 (though remaining longitudinally stationary).

In the present embodiment, supplementary attachment 114 is a single purpose cleaning device. In other embodiments, a supplementary attachment could be a drilling bit without any ports for ejection of fluid jets (referred as single-purpose drilling bit hereinafter). The single-purpose drilling bit of such embodiments would be rotated by the fluid jets ejected from lower-sub 112. Such embodiments can be used for cleaning while drilling. In yet other embodiments, supplementary attachment 114 could be a dual-purpose device (such as a dual-purpose drilling bit with ejection ports for added cleaning and rotational force).

It is to be understood that dimensions and shape of each of fluid ejection port 132 (and their distribution on lower-sub 112), and dimensions and shape of each of fluid ejection port 134 (and their distribution on supplementary attachment 114) is selected in accordance with the requirements and operating environment. For example, for a given shape of fluid ejection port and a constant fluid pressure, a smaller diameter fluid ejection port would eject a lesser volume of fluid with greater velocity, and a larger diameter fluid ejection port would eject a larger volume of fluid with reduced velocity.

Figure 5A:
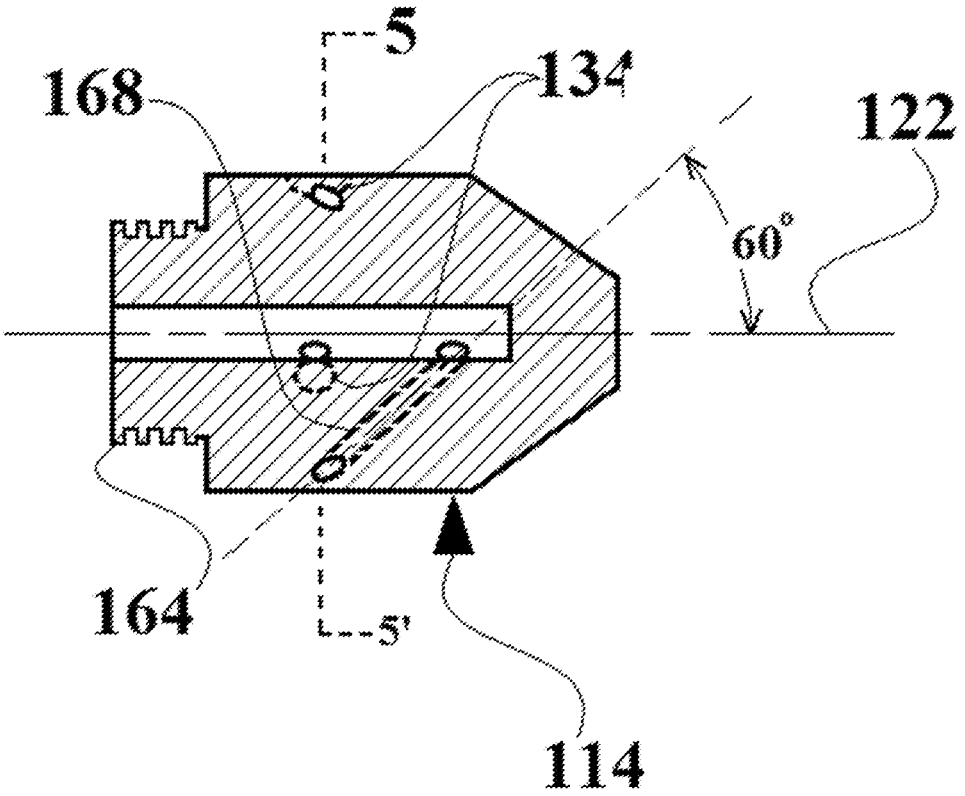
FIG. 5A illustrates a cross-section of another type of supplementary attachment taken along its longitudinal axis.
Figure 5B:
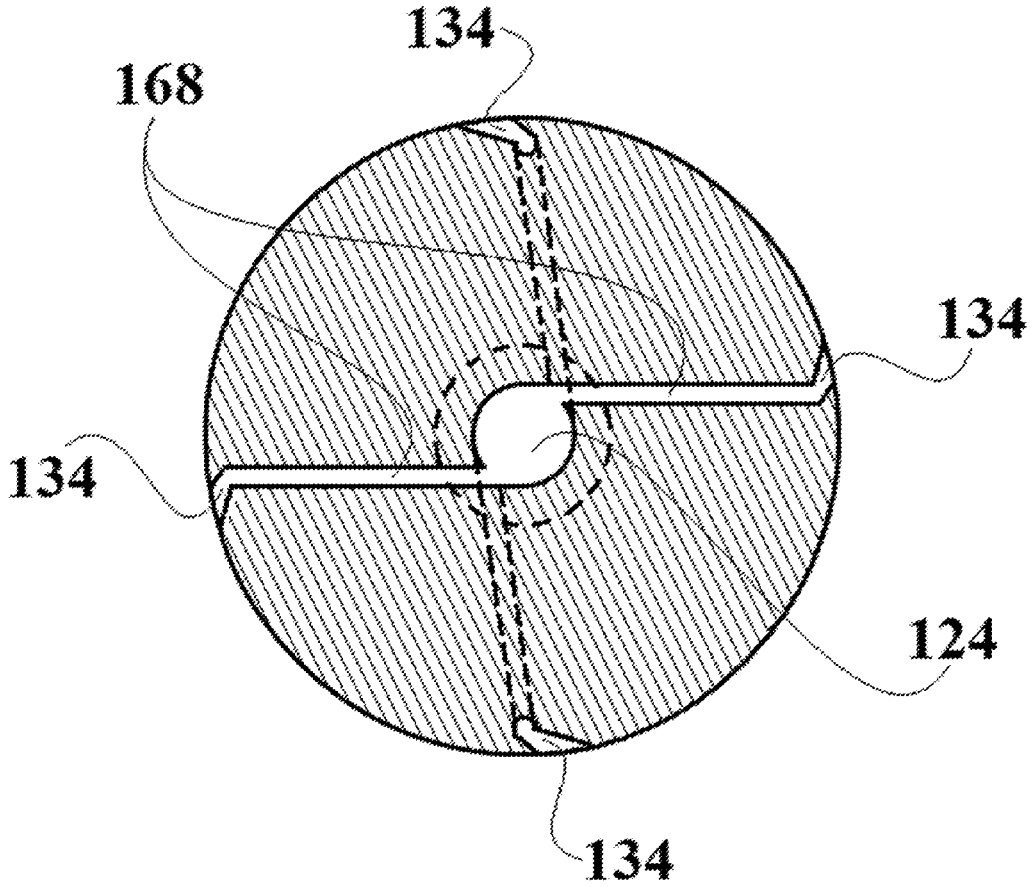
FIG. 5B illustrates a cross-section of the supplementary attachment of FIG. 5A taken along the lines 5-5' of FIG. 5A.

FIGS. 5A and 5B illustrate another type of supplementary attachment usable with the first embodiment of the invention described above. The supplementary attachment illustrated in FIGS. 5A and 5B includes four branched passages. While two of these branched passages lie substantially transverse to longitudinal axis, the other two branched passages lie tilted towards the lower-sub of the cleaning device at an angle of about 60 degrees with respect to longitudinal axis. In an operational cleaning device, these two branched passages lie tilted away from the bottom of the well-bore and would eject jets which would be tangential to an outer surface of the supplementary attachment and would be ejected away from the bottom of the bore well. Similar to fluid ejection ports 134, each fluid ejection port of the supplementary attachment illustrated in FIGS. 5A and 5B has a progressively widening inner diameter from their innermost to their outermost end.

Figure 4:
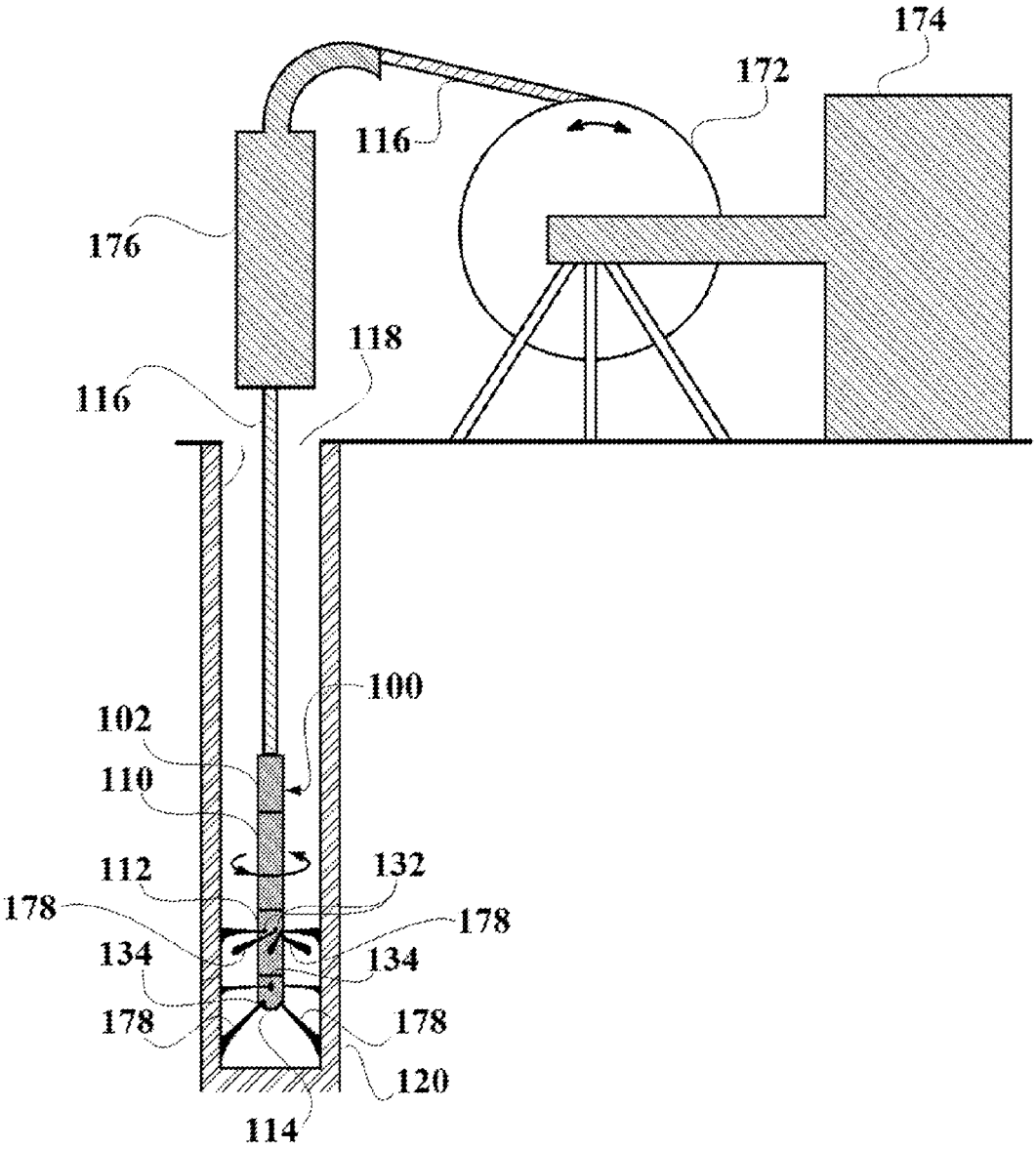
FIG. 4 illustrates a coil tubing system for cleaning an oil well-bore using the first embodiment of the cleaning device of the present invention, with the well-bore in cross-section and the above-ground portions of the system in elevational view.

Returning back to the first embodiment of the invention, operation of the cleaning device 100 for cleaning target portions and installed equipment within a well-bore 120 will now be explained in detail with reference to FIG. 4. As illustrated, to perform cleansing action, the coiled tubing 116 wound on a coil tubing drum 172 and having the cleaning device 100 attached at one end is inserted in the bore casing 118 of the well-bore 120. Vertical movement of the coiled tubing 116 and the cleaning device 100 is facilitated by rotation of the coil tubing drum 172. Further, rotation of the coil tubing drum 172 is controlled by drive motor which may be placed within a control system 174 or in an injector 176 (for simplicity of current description, components of control system 174 and the injector 176 are not illustrated in FIG. 4).

For cleaning target portions in bore casing 118 by cleaning device 100, firstly, lower-sub 112 and supplementary attachment 114 are placed in proximity to the target portion. Thereafter, pressurized cleaning fluid/mud (or drilling fluid/mud) is injected to the cleaning device 100 through the coiled tubing 116. Injected pressurized cleaning fluid/mud (or drilling fluid/mud) travels through the longitudinal passage 124 (not illustrated in FIG. 4) and gets ejected as jets of fluid through fluid ejection ports 132 and 134. The ejected jets of fluid from both fluid ejection ports 132 and 134 (illustrated as jets 178 in FIG. 4) hit the target portions and dislodge target substance (such as stuck mud/dirt or debris). While the fluid jets eject through the fluid ejection ports 132 and 134, they generate a rotational torque on lower-sub 112 and supplementary attachment 114 (and components screwed to it such as holding cylinder 108). This causes lower-sub 112 and supplementary attachment 114 to spin on longitudinal axis 122. The dislodged material is then carried through well-bore 120 towards the surface of earth by the ejected cleaning fluid/mud which is being pushed (or pumped) towards the earth's surface.

In other embodiments of the invention wherein supplementary attachment 114 is a dual-purpose drilling bit (as explained above), cleaning device 100 can also be used to drill a well-bore deeper and simultaneously get the bottom of well-bore 120 cleaned from mud and rock debris generated during drilling. To achieve this, cleaning device 100 is lowered into well-bore 120 so that the dual-purpose drilling bit reaches the bottom of well-bore 120, and pressurized cleaning fluid/mud (or drilling fluid/mud) is injected into cleaning device 100 through coiled tubing 116. Injected pressurized cleaning fluid/mud (or drilling fluid/mud) travels through longitudinal passage 124 of cleaning device 100 and gets ejected as jets of fluid through fluid ejection ports 132 (on the lower-sub 112) and 134 (on the dual purpose drilling bit). The rotational torque on lower-sub 112 and supplementary attachment 114 (and components screwed to it such as holding cylinder 108) from the ejected fluid drives the drilling bit to drill through the well-bore 120, while the ejected fluid and also dislodges the mud and rock debris by drilling.

It is to be understood that the foregoing description and embodiments are intended to merely illustrate and not limit the scope of the invention. Other embodiments, modifications, variations and equivalents of the invention are apparent to those skilled in the art and are also within the scope of the invention, which is only described and limited in the claims which follow, and not elsewhere.

What is claimed is:

1. A method of cleaning a target portion of an oil well-bore, comprising:

connecting a substantially cylindrical cleaning device to one end of a length of coil tubing which is wound around a drum;

reeling the coil tubing from the drum into the well-bore and placing the cleaning device proximal to the target portion;

injecting pressurized fluid from the coil tubing into the cleaning device having a longitudinal axis, where it travels along a longitudinal passage and into a plurality of distribution passages extending transversely to the longitudinal axis towards the outside of the cylindrical device in a first direction, and wherein the distribution passages connect with ejection ports which exit outside the device, said ejection ports having a graduated, progressively widening inner diameter from their innermost to their outermost end and wherein the narrowest region of said inner diameter is no narrower than the connecting inner diameter of the distribution passages, and wherein said ejection ports extend in a second direction, which is transverse to the longitudinal axis and towards the outside of the cylindrical device but at an obtuse angle relative to the first direction such that the ejection ports eject the fluid substantially tangentially to the outer surface of the cleaning device to generate a rotational torque and cause one or more components of the cleaning device to spin about the longitudinal axis while the fluid is ejected.

2. The method of claim 1, wherein said cleaning device is further connected to a supplementary attachment which includes an additional set of fluid ejection ports on its outer side connected to the longitudinal passage through a set of branched passages, wherein the branched passages extend at an acute angle to the longitudinal axis and towards the outside of the cylindrical device in a third direction, and wherein the branched passages connect with the secondary ejection ports, said secondary ejection ports having a graduated, progressively widening inner diameter from their innermost to their outermost end and wherein the narrowest region of said inner diameter is no narrower than the connecting inner diameter of the branched passages, and wherein said secondary ejection ports extend in a fourth direction, which is towards the outside of the supplementary attachment but at an obtuse angle in the horizontal plane, relative to the first direction.

3. The method of claim 2, wherein one or more of said branched passages are angled at about 60 degrees to the longitudinal axis and face downwardly away from the coiled tubing.

4. The method of claim 2, wherein one or more of said branched passages are angled at about 60 degrees to the longitudinal axis and face towards the coiled tubing rather than downwardly.

5. The method of claim 2, wherein said supplementary attachment is a dual-purpose drilling bit.

6. A substantially cylindrical cleaning device for cleaning a target portion of an oil well-bore through ejecting fluid, said device comprising:

a longitudinal passage and a plurality of distribution passages extending from the longitudinal passage, wherein the distribution passages extending transversely to the longitudinal axis towards the outside of the cylindrical device in a first direction, and wherein the distribution passages connect with ejection ports which exit outside the device, said ejection ports having a graduated, progressively widening inner diameter from their innermost to their outermost end, and wherein the narrowest region of said inner diameter is no narrower than the connecting inner diameter of the distribution passages, and wherein said ejection ports extend in a second direction, which is transverse to the longitudinal axis and towards the outside of the cylindrical device but at an obtuse angle relative to the first direction such that the ejected jets of fluid are substantially tangential to the outer surface of the cleaning device, and ejection of the jets of fluid generates rotational torque to thereby cause one or more components of the cleaning device to spin about the longitudinal axis.

7. The device of claim 6, wherein said cleaning device is further connected to a supplementary attachment which includes an additional set of secondary ejection ports on its outer side connected to the longitudinal passage through a set of branched passages, wherein the branched passages extend at an acute angle to the longitudinal axis and towards the outside of the cylindrical device in a third direction, and wherein the branched passages connect with the secondary ejection ports, said secondary ejection ports having a graduated, progressively widening inner diameter from their innermost to their outermost end and wherein the narrowest region of said inner diameter is no narrower than the connecting inner diameter of the branched passages, and wherein said secondary ejection ports extend in a fourth direction, which is towards the outside of the supplementary attachment but at an obtuse angle in the horizontal plane, relative to the first direction.

8. The device of claim 7, wherein said supplementary attachment is a dual purpose drilling bit.

9. The device of claim 8 wherein the jets of fluid ejected by said set of secondary ejection ports are substantially tangential to the outer surface of the dual-purpose drilling bit.

10. A device for cleaning a target portion of an oil well-bore, comprising: a substantially cylindrical cleaning device, said cleaning device comprising a longitudinal passage and plurality of distribution passages extending from the longitudinal passage, wherein the distribution passages connect with ejection ports which exit outside the device, said ejection ports having a graduated, progressively widening inner diameter from their innermost to their outermost end, and wherein the narrowest region of said inner diameter is no narrower than the connecting inner diameter of the distribution passages;

said ejection ports extending in a second direction which is transverse to the longitudinal axis and towards the outside of the cylindrical device but at an obtuse angle relative to the direction of the distribution passages, such that on injection of pressurized fluid into the longitudinal passage, jets of fluid are ejected from said fluid ejection ports, the ejected jets of fluid being substantially tangential to the outer surface of the cleaning device, and ejection of the jets of fluid generates rotational torque to cause one or more components of the cleaning device to spin about the longitudinal axis.

11. The device of claim 10, wherein said cleaning device is further connected to a supplementary attachment which includes an additional set of secondary ejection ports connected to the longitudinal passage through a set of branched passages, wherein the branched passages extend at an acute angle to the longitudinal axis and towards the outside of the cylindrical device in a third direction, and wherein the branched passages connect with the secondary ejection ports, said secondary ejection ports having a graduated, progressively widening inner diameter from their innermost to their outermost end and wherein the narrowest region of said inner diameter is no narrower than the connecting inner diameter of the branched passages, and wherein said secondary ejection ports extend in a fourth direction, which is towards the outside of the supplementary attachment but at an obtuse angle in the horizontal plane, relative to the first direction.

12. The device of claim 11, wherein the secondary ejection ports eject fluid at an angle of about 60° to the longitudinal axis.

13. The device of claim 12, wherein the secondary ejection ports face downwardly.

14. The device of claim 12, wherein the secondary ejection ports face upwardly.

15. The device of claim 11, wherein the supplementary attachment is a dual-purpose drilling bit.

16. The device of claim 15, wherein the secondary ejection ports eject fluid at an angle of about 60° to the longitudinal axis.

17. The device of claim 16, wherein the secondary ejection ports face downwardly.

18. The device of claim 16, wherein the secondary ejection ports face upwardly.

19. The device of claim 15 wherein the jets of fluid ejected by said secondary ejection ports are substantially tangential to the outer surface of the dual-purpose drilling bit.

* * * * *